US007097532B1

(12) United States Patent
Rolicki et al.

(10) Patent No.: US 7,097,532 B1
(45) Date of Patent: Aug. 29, 2006

(54) MOBILE DEVICE WITH COLOR DISCRIMINATION

(76) Inventors: Peter Rolicki, 167 Elsinore St., Apt. 4, Concord, MA (US) 01867; Judith Neely Coltman, 18 Milton Rd., Reading, MA (US) 01867; John Gaewsky, 41 Beaver Rd., Reading, MA (US) 01867

( * ) Notice: Subject to any disclaimer, the term of this patent is extended or adjusted under 35 U.S.C. 154(b) by 0 days.

(21) Appl. No.: 10/966,758

(22) Filed: Oct. 16, 2004

Related U.S. Application Data

(60) Provisional application No. 60/520,564, filed on Nov. 17, 2003.

(51) Int. Cl.
*A63H 30/00* (2006.01)

(52) U.S. Cl. ..... 446/175; 446/219

(58) Field of Classification Search ..... 446/438, 446/439, 219, 175
See application file for complete search history.

(56) References Cited

U.S. PATENT DOCUMENTS 4,874,343 A * 10/1989 Rosenthal ..... 446/175
5,630,743 A * 5/1997 Shi ..... 446/175
6,224,454 B1 * 5/2001 Cheng et al. ..... 446/175

* cited by examiner

*Primary Examiner*—Kien Nguyen
(74) *Attorney, Agent, or Firm*—Joseph Stecewycz

(57) ABSTRACT

A mobile device with color discrimination for producing one of a plurality of pre-determined physical actions when disposed on an action surface includes a body having a set of wheels and a third point of contact with the action surface; means for executing a physical action; a color detection module including a broad spectrum illumination source with a source lens, the illumination source for producing a spot of light on the action surface; a photodetector with a bandpass filter, the photodetector for receiving light reflected from the spot of light and passed through the bandpass filter; a second photodetector with a second bandpass filter, the second photodetector for receiving light reflected from the spot of light and passed through the second bandpass filter; an electronics module including comparator circuits in electronic communication with the photodetectors; and a microcircuit in electronic communication with the comparator circuits and with the means for executing a physical action.

20 Claims, 13 Drawing Sheets

109

| Color | Action | Left Motor Speed | Right Motor Speed | Horn |
|---|---|---|---|---|
| **Red** | Wobble | 0%/50% | 50%/0% | Off |
| **Green** | Turn right | 75% | 25% | Off |
| **Blue** | Turn left | 25% | 75% | Off |
| **Magenta** | Start/stop & honk horn | 50%/0% | 50%/0% | On |
| **Yellow** | Enter spin mode | 0% | 75% | Off |
| **Cyan** | Ahead full speed | 100% | 100% | Off |
| **White** | Ahead normal speed | 50% | 50% | Off |

Fig. 12

MOBILE DEVICE WITH COLOR DISCRIMINATION

CROSS-REFERENCE TO RELATED APPLICATION

The present Application is related to Provisional Patent Application entitled "Self-Propelled Device with Guidance System Having Color Detection Capability" filed 17 Nov. 2003 and assigned Ser. No. 60/520,564.

DESCRIPTION OF THE INVENTION

The present invention relates to mobile devices and, in particular, to a mobile toy that produces physical actions in response to the detection of a color.

BACKGROUND OF THE INVENTION

Description of the Background Art

The present state of the art has seen the development of toy vehicles that can provide responses to operator direction or commands. U.S. Pat. No. 6,568,983 issued to Peters, for example, discloses a toy vehicle in which forward progress may be controlled by means of an onboard video camera. U.S. Pat. No. 5,085,148 issued to Konno discloses a toy vehicle in which change in vehicle direction is effected by means of an infrared signal transmitted to the toy vehicle. U.S. Pat. No. 4,086,724 issued to McCaslin discloses a toy vehicle in which vehicle direction can be controlled by an external command, such as a voice command or a light from an external source. U.S. Pat. No. 4,865,575 issued to Rosenthal discloses a toy vehicle operated in response to a beam of colored control light from a handheld controller. U.S. Pat. No. 4,925,424 issued to Takahashi discloses a toy vehicle adapted to run on a track using a pattern detection unit to vary the speed and direction of the toy vehicle.

However, such toy vehicles are sensitive to signals of, at most, only a single color present on an action surface or sent by an operator. This design feature results in the toy vehicle having a limited number of responsive actions, such as merely following a predetermined track or path, or performing a single physical movement, for example. What is needed is a method and system for providing a greater number of predictable or random actions from a mobile toy, such as may be produced in response to the discrimination of a plurality of colors detected on a play surface.

SUMMARY OF THE INVENTION

The disclosed system and method utilize a color detection capability to provide a mobile device that produces a range of physical actions when disposed on an action surface. The mobile device includes a body having a set of wheels and an optional caster for providing at least three points of contact with the action surface; means for executing the physical actions; a color detection module including a broad spectrum illumination source with a source lens, the illumination source for producing a spot of light on the action surface; a first photodetector with a first bandpass filter, the first photodetector for receiving a first portion of light reflected from the spot of light and passing through the first bandpass filter; a second photodetector with a second bandpass filter, the second photodetector for receiving a second portion of light reflected from the spot of light and passing through the second bandpass filter; an electronics module including a first comparator circuit in electronic communication with the first photodetector; a second comparator circuit in electronic communication with the second photodetector; a microcircuit in electronic communication with the first comparator circuit and the second comparator circuit, the microcircuit further in communication with the means for executing a physical action.

DESCRIPTION OF THE DRAWINGS

FIG. 12 is a decision table illustrating one set of actions which may be taken by the mobile device of FIG. 3;

DETAILED DESCRIPTION OF THE INVENTION

Figure 1:
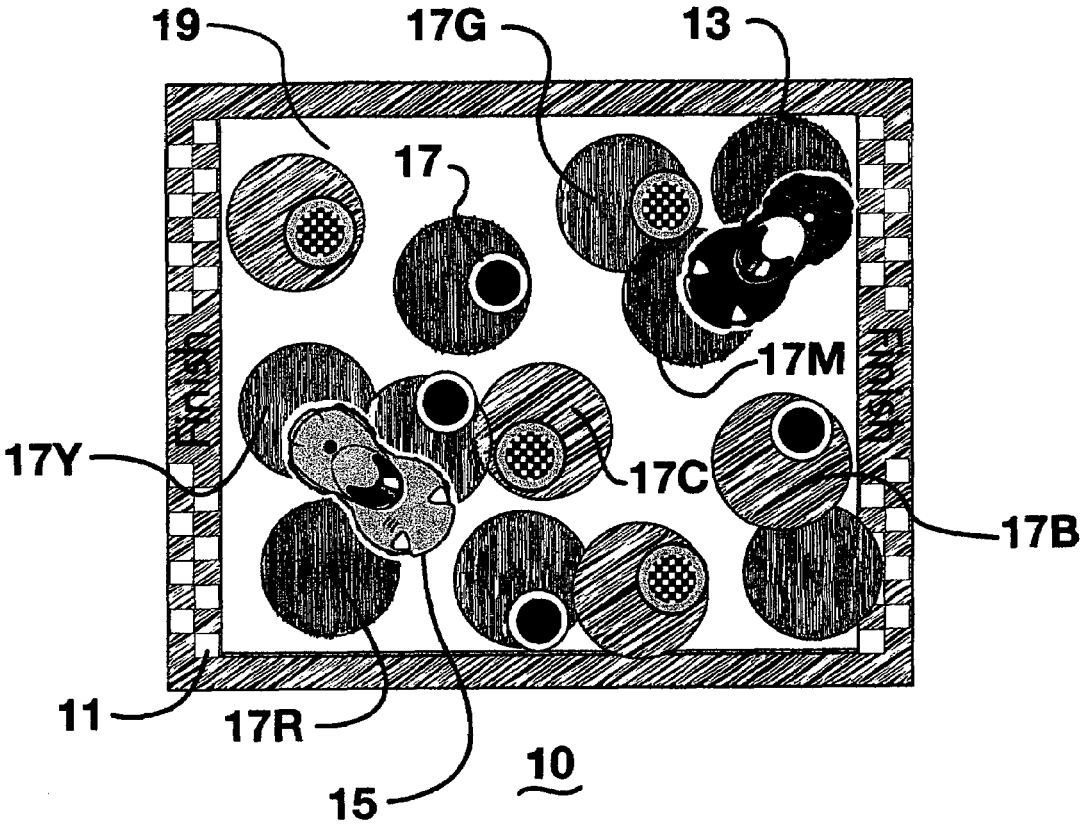
FIG. 1 is an illustration showing a plan view of mobile devices disposed on a planar action surface having a plurality of colored regions, according to the present invention.

There is shown in FIG. 1 a first embodiment of an action game 10, including an action surface 11 upon which are disposed a powered mobile device 13 and a non-powered mobile device 15, in accordance with the present invention.

The action surface 11 is a generally planar surface that may comprise a plurality of colored regions. In the example provided, the colored regions comprise a plurality of colored circles 17 disposed on a white background 19 to form a varicolored configuration. The action surface 11 may include, for example, one or more yellow circles 17Y, green circles 17G, red circles 17R, blue circles 17B, a cyan circle 17, and magenta circles 17M.

Figure 2:
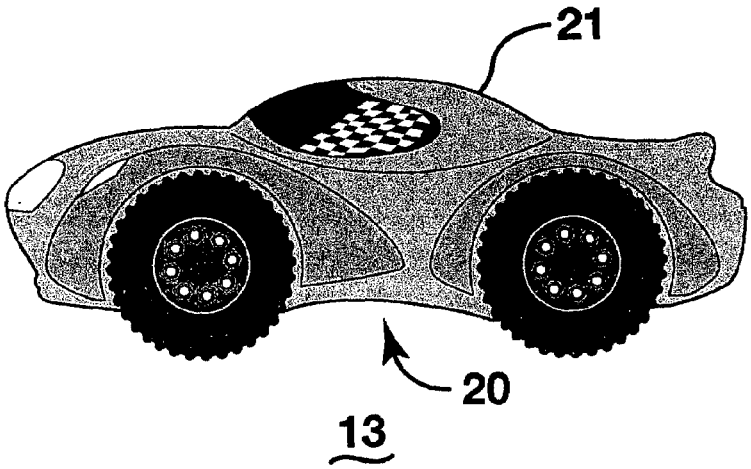
FIG. 2 is an illustration of one of the mobile devices of FIG. 1, showing an outer enclosure in the shape of a toy automobile mounted on a mobile body.

The powered mobile device 13, also shown in FIG. 2, may be configured to translate or move across the action surface 11 in a self-propelled mode, as explained in greater detail below. The powered mobile device 13 may include an outer enclosure 21 mounted onto a powered mobile body 20. The outer enclosure 21 is preferably a hollow molded, enclosure fabricated from a durable plastic-like material that can withstand use by children. The outer enclosure 21 may be formed as a vehicle (e.g., automobile, race car, SUV, tank, airplane), an animal, a human figure, and a sport accessory (e.g., hockey puck), for example.

As the powered mobile device 13 moves onto one of the magenta circles 17M, the color of the magenta circle 17M is identified by the powered mobile device 13 and, in response to the color identification, the powered mobile device 13 executes a related physical action, such as a turning action or by generating a sound, for example. The powered mobile device 13 may then continue across the action surface 11 to move onto the cyan circle 17C, and execute a second physical action in response to the color identification of the cyan circle 17C.

The non-powered mobile device 15 may be configured to move across the action surface 11 via an externally-applied force, such as may be provided when a user of the action game 10 pushes or turns the non-powered mobile device 15. As the non-powered mobile device 15 moves onto one of the yellow circles 17Y, the yellow color is identified by the non-powered mobile device 15 and, in response to the color identification as yellow, the non-powered mobile device 15 executes a related physical action, such as by momentarily stopping or by flashing a light, for example. The non-powered mobile device 15 may then continue across the action surface 11 to move onto one of the green circles 17G, and execute yet another physical action. Alternative physical actions performed by the powered mobile device 13 and the non-powered mobile device 15 may include discharging a gas, liquid, or solid particles, or providing a lighted display, or performing a combination of two or more physical actions, for example, from a physical action module described in greater detail below.

Figure 3:
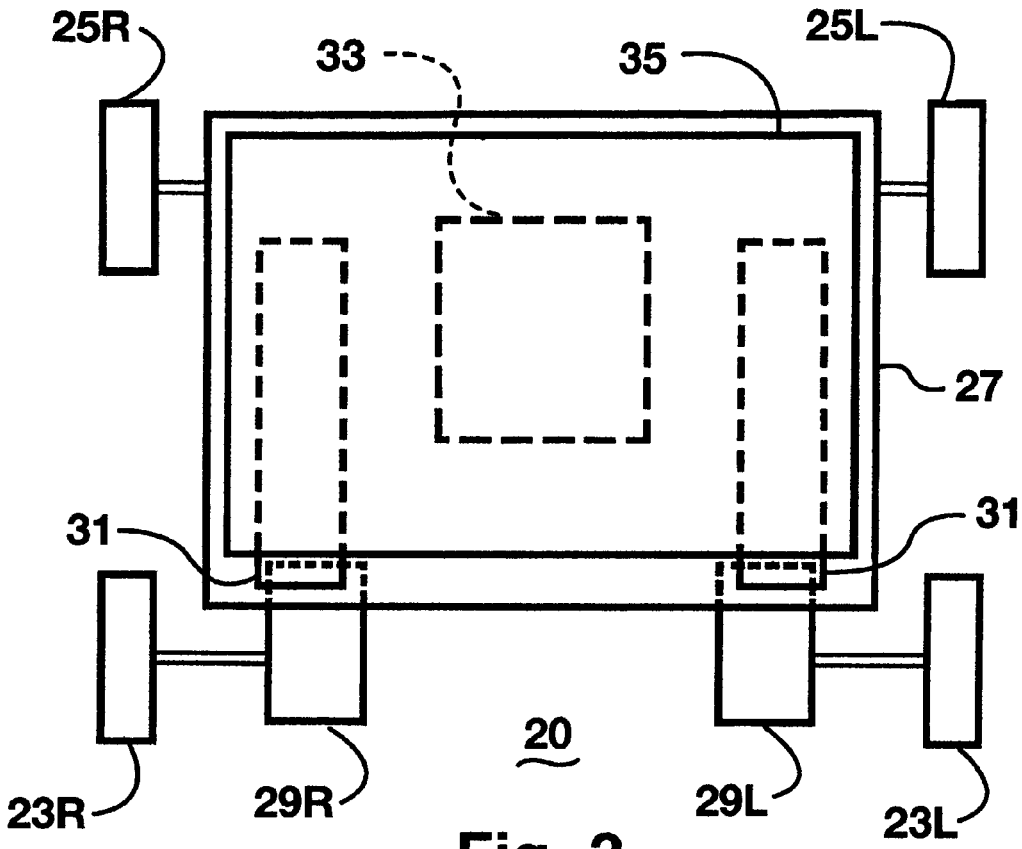
FIG. 3 is a diagrammatical illustration of a top view of the mobile body of FIG. 1, showing a color-sensing module and an electronics module.
Figure 4:
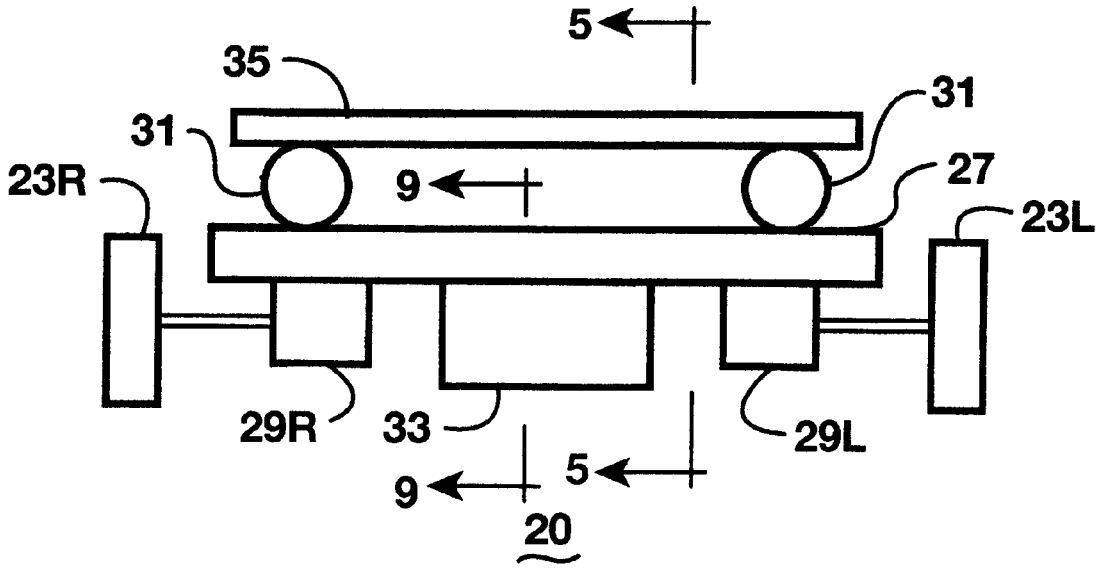
FIG. 4 is a diagrammatical illustration of a front view of the mobile body of FIG. 3.
Figure 5:
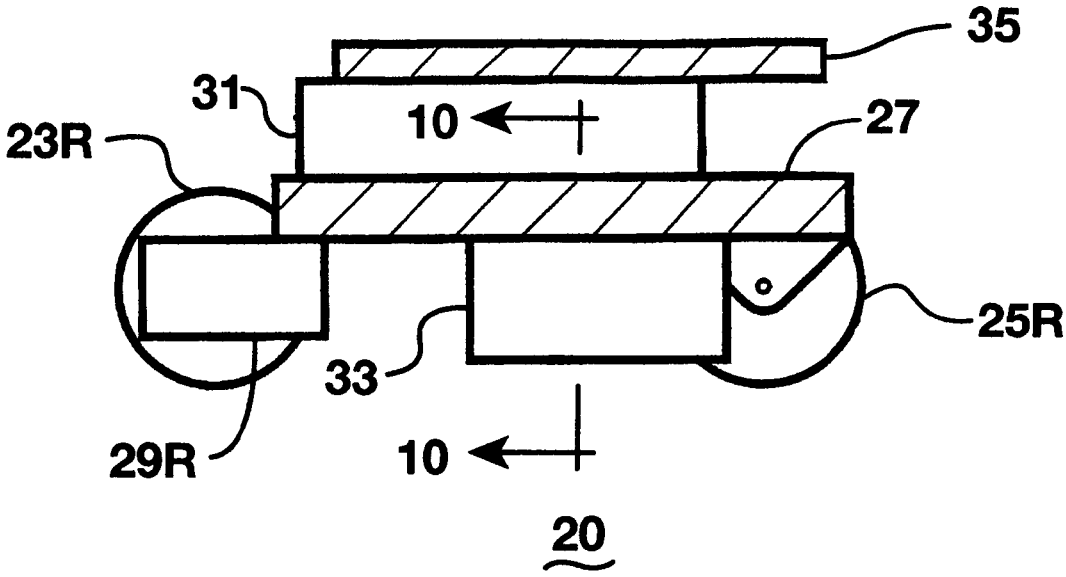
FIG. 5 is a diagrammatical sectional view of the mobile body of FIG. 3 taken along the sectional lines shown in FIG. 4.

As shown in FIGS. 3–5, the powered mobile body 20 may include a support body 27, a right drive wheel 23R and a left drive wheel 23L to provide two points of contact with the action surface 11. The powered mobile body 20 also includes at least a third point of contact with the action surface 11. In the example provided, the powered mobile body further includes a right rear wheel 25R and a left rear wheel 25L. The outer enclosure 21 (not shown in FIGS. 3–5 for clarity of illustration) may comprise a molded housing configured as an automotive body (shown in FIG. 1), an animal, or other figurine, as well-known in the relevant art. Motive power and steering may be provided to the powered mobile device 13 via a right electrical motor 29R coupled to the right drive wheel 23R and a left electrical motor 29L coupled to the left drive wheel 23L. The right electrical motor 29R and the left electrical motor 29L may comprise reversible motors, and may be powered by one or more batteries 31, solar cells (not shown) or similar power sources. In an alternative embodiment, the powered mobile device 13 may include an internal spring (not shown) for wind-up operation, in place of the electrical motors 29R, 29L and the batteries 31.

A color-detection module 33 and an electronics module 35 may be attached to the support body 27. As explained in greater detail below, the powered mobile device 13 operates by determining the color of a region of the action surface 11 below the support body 27, by means of the color-detection module 33, and responding with a predefined action or behavior determined by a set of instructions resident in the electronics module 35. The responsive action may be a particular movement executed by the powered mobile device 13, where the movement is produced by activating the electric motors 29R and 29L to rotate one or both of the drive wheels 23R and 23L in clockwise and/or counterclockwise directions. It should be understood that FIGS. 3–5 are meant to show only approximate locations of the major components, and that, for clarity of illustration, the Figures do not include electrical interconnections and conventional structural components as may be utilized in accordance with typical design and fabrication requirements well-known in the relevant art.

The non-powered mobile device 15 is similar in construction to the powered mobile device 13 except that the non-powered mobile device 15 will not require the batteries 31 and right and left structural supports (not shown) may be used in place of the right electrical motor 29R and the left electrical motor 29L, respectively. Physical actions performed by the non-powered mobile device 15 may include generating a sound, flashing a light, discharging a gas, liquid, or solid particles, providing a lighted display, or performing a combination of two or more such physical actions, as described in greater detail below.

Figure 8:
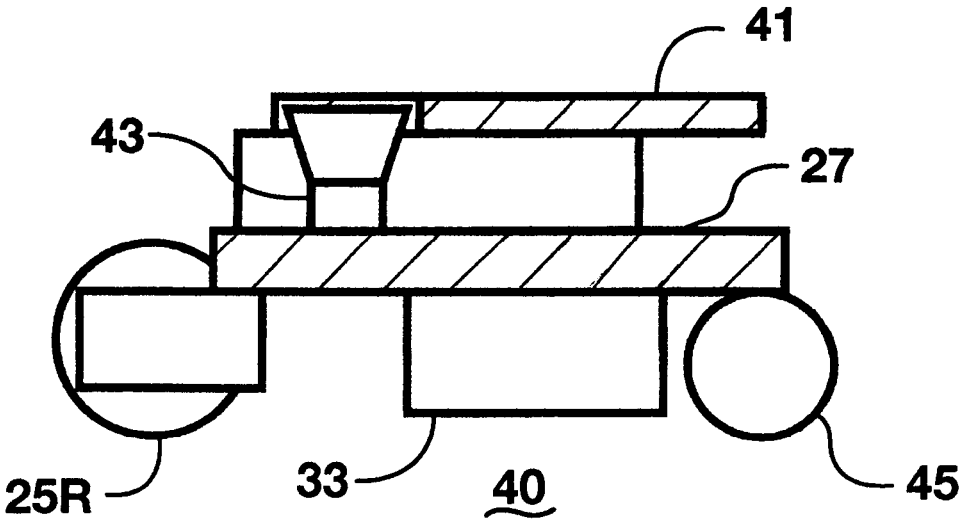
FIG. 8 is a diagrammatical sectional view of the alternative mobile body of FIG. 6 taken along the sectional lines shown in FIG. 7.
Figure 6:
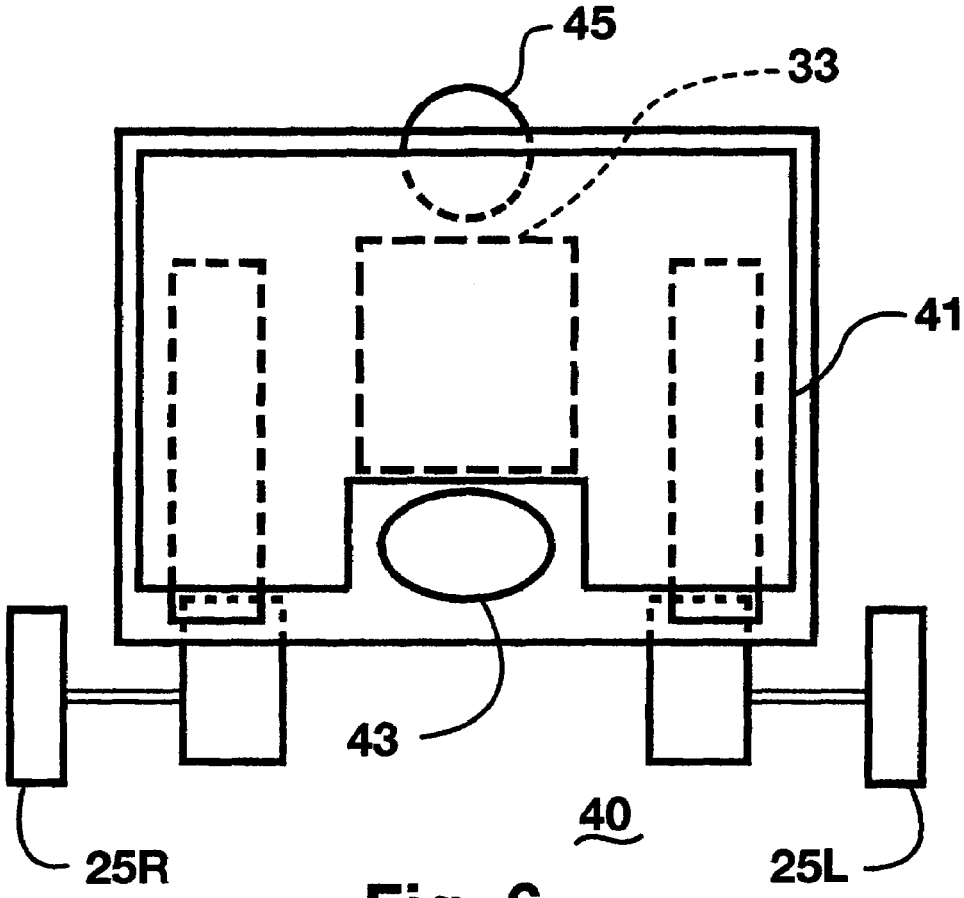
FIG. 6 is a diagrammatical illustration of a top view of an alternative embodiment of the mobile body of FIG. 1.
Figure 7:
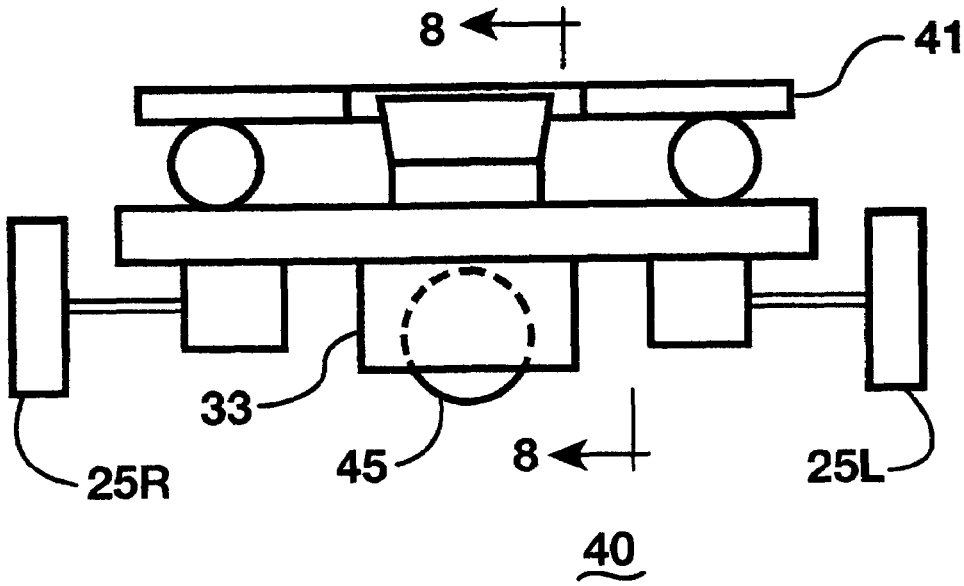
FIG. 7 is a diagrammatical illustration of a front view of the alternative mobile body of FIG. 6.

As shown in FIGS. 6–8, an alternative embodiment of a powered mobile body 40 may include the support body 27, the right and left drive wheels 23R and 23L, and the right and left electrical motors 29R and 29L. The color-detection module 33 and an alternate electronics module 41 may be attached to the support body 27. It should be understood that FIGS. 6–8 are also meant to show only approximate locations of the major components. The powered mobile body 40 may also include a physical action module 43 that may emit light, a sound, or smoke, for example, upon a signal provided by the electronics module 41. In addition, the powered mobile body 40 may include a caster 45 for providing the powered mobile body 40 a third point of contact with the action surface 11 of FIG. 1.

Figure 9:
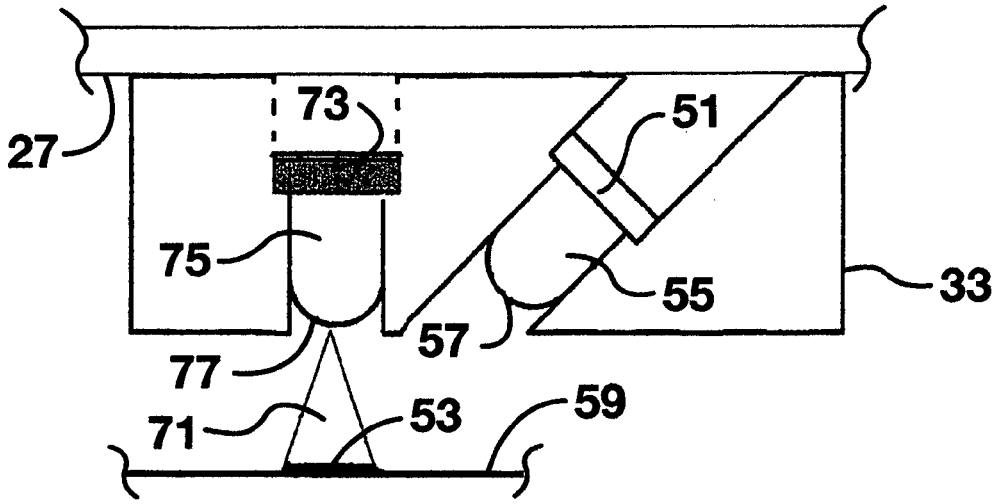
FIG. 9 is a sectional view of the color-sensing module of FIG. 3 taken along the sectional lines shown in FIG. 4.

As shown in FIG. 9, the color-detection module 33 may include a broad-spectrum illumination source 51, such as a white light-emitting diode (LED), an incandescent light source, or an arc source. The illumination source 51 projects a light spot 53 via a source lens 55 onto a support surface 59 under the powered mobile body 40. If an incandescent lamp or arc source is used as the illumination source 51, an optional infrared blocking filter 57 can be provided either on the source lens 55 or between the source lens 55 and the support surface 59 to eliminate the color-masking effect of the infrared energy emitted by the incandescent lamp.

Figure 10:
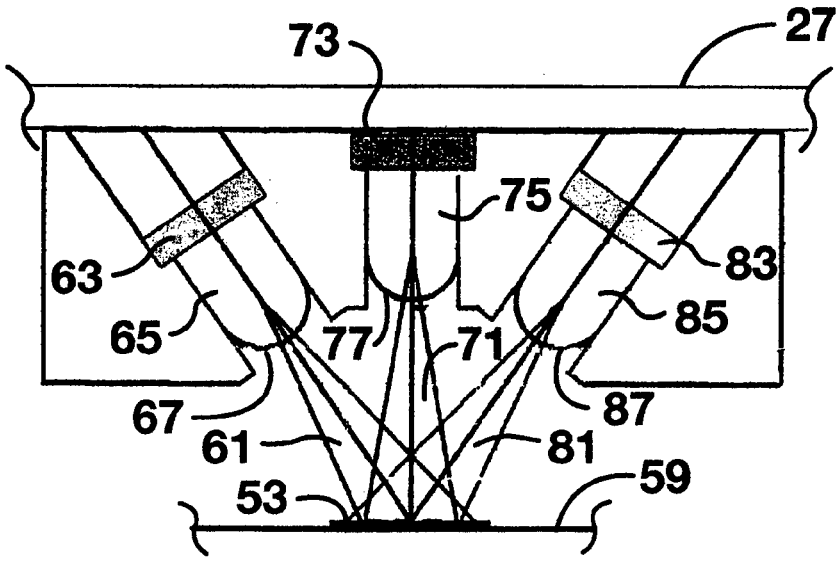
FIG. 10 is a sectional view of the color-sensing module of FIG. 3 taken along the sectional lines shown in FIG. 5.
Figure 11:
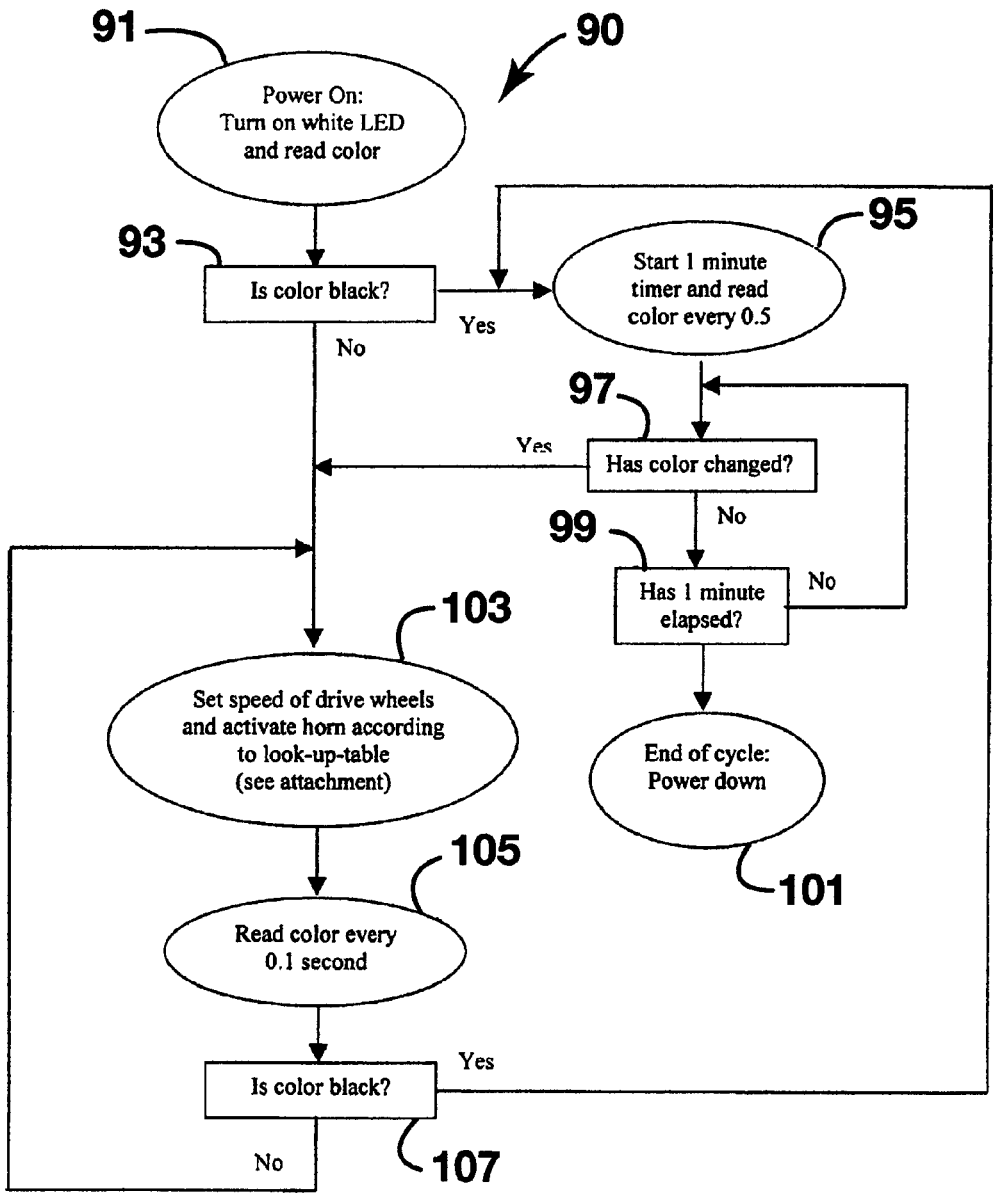
FIG. 11 is a flow diagram illustrating one sequence of operations which may be performed by the mobile body of FIG. 3.

With additional reference to FIG. 10, a beam 61 is reflected from the light spot 53 to a photodetector 63. The beam 61 is focused by a lens 65 onto the photodetector 63 to produce signals, after passing through a bandpass filter 67 on or proximate the surface of the lens 65. The bandpass filter 67 may be a red filter, for example, and the photodetector 63 can be used to detect whether red light is being reflected from the light spot 53. Similarly, a second beam 71 from the spot of light 53 is focused by a second lens 75 onto a second photodetector 73 to produce signals, after passing through a second bandpass filter 77 on or proximate the surface of the second lens 75, as also shown in FIG. 5. The second bandpass filter 77 may be a blue filter, for example, and the second photodetector 73 can then be used to detect blue light reflected from the light spot 53. The signals from the photodetector 63 and the second photodetector 73 are transmitted to the electronics module 35, as explained in greater detail below.

In an alternative embodiment, a third photodetector 83 may be used in combination with a third lens 85 to collect a third beam 81 from the light spot 53 via a third bandpass filter 87, such as a green filter, on or proximate the third lens 85. The signals from the third photodetector 83, when present, are also transmitted to the electronics module 35. The bandpass filters 67, 77, and 87 are preferably selected to pass a narrow range of wavelengths centered about each respective primary color. To improve the reliability of color detection, the photodetectors 63, 73, and 83 are located as close to the light spot 53 as practical. Also, an ambient light shield (not shown) can be provided substantially enclosing the color-detection module 33 to prevent stray ambient light from directly or indirectly reaching the photodetectors 63, 73, and 83. The lenses 65, 75, and 85 may comprise ball lenses, cylindrical lenses, or Fresnel lenses, for example. It should be understood that the positions of the photodetectors 63, 73, and 83 and the illumination source 51 can be varied from the configuration shown, depending upon the fabrication requirements of the mobile device with the constraint that the illumination source 51 project the light spot 53 onto support surface 59 such that the photodetectors 63, 73, and 83 can detect the reflection of the beams 61, 71, and 81 from the support surface 59.

It is known in the relevant art to use infrared sensing technology for the purpose of following a line marked on a play surface. Although IR technology is inexpensive and reliable, it is limited to simple on-off decisions and therefore, the controlled action or behavior is generally limited to a single function. As can be appreciated from the above description, the powered mobile device 13 is configured to sense two or more colors in the visible spectrum and utilize the sensed color information to provide for a greater number of controlled actions or behaviors.

The color sensing technology described herein thus allows for the greater number of controlled behaviors because there are eight readily-detected primary colors which, in one embodiment, can each be linked to the control or production of a unique behavior for the powered mobile device 13. As color has been shown to be a tri-stimulus phenomenon, essentially all visible-light colors maybe identified by the detected value of three primary colors. These primary colors can be specified as either: a.) the set of red, green, and blue (RGB), or b.) the set of cyan, magenta, and yellow with black (CMYK). In the simplest application, each of the photodetectors 63, 73, and 83 can then be used as a binary detector by determining whether a respective spectrum band of the light reflected from the spot of light 53 exceeds a predetermined threshold. With this configuration, binary detection of each of the three primary colors will provide a detection system capable of identifying surfaces of at least eight different colors. Binary detection of two of the three primary colors will provide a detection system capable of identifying surfaces of at least four different surface colors. The color sensing may be conducted in either a reflective or a transmissive mode, depending whether the surface material to be sensed is opaque or transparent.

Operation of the powered mobile device 13 can be described with reference to a flow diagram 90 shown in FIG. 10. At power-on, the broad-spectrum illumination source 51 projects the spot of light 53 onto the action surface 11 below the powered mobile device 13. The color-detection module 33 then is used to input light beams 61 and 71 (for discrimination among at least four colors other than black) reflected from the action surface 11 and to then determine the color(s) comprising the reflected light, at step 91. Optionally, the third beam 81 may also be input to the color-detection module 33 to provide for discrimination among at least eight colors other than black. If no reflected light is detected, the surface color is determined to be black, at decision block 93. A one-minute timer is started in the electronics module 35 and successive readings are made of the surface every 0.5 second, for example, at step 95.

If, after successive sampling, the powered mobile device 13 has moved onto a region of the action surface 11 which is determined to be one of at least four colors other than black, at decision block 97, step 103 is executed and an action is performed in accordance with a look-up table, such as a table 109 in FIG. 12. Otherwise, if the color of the surface is still detected as black, at decision block 97, a determination is made whether a predetermined time interval, such as one minute, has passed, at step 99. If the predetermined time interval has not passed, the reading of the surface is again checked to determine if the local surface is still black, at step 93. If the predetermined time interval has passed, the electronics module 35 signals the end of the current cycle, at step 101, and powers down the powered mobile device 13.

At step 103, the powered mobile device 13 executes the predefined physical action or behavior specified by a set of instructions resident in the electronics module 35 in response to the determination of a color other than black on the surface. The predefined action or behavior corresponds to one of the four or more colors detectable by the color detection module 33. Following execution of the physical action in step 103, the powered mobile device 13 continues to move along and sample the color of the surface every 0.1 second, at step 105. If the sampled color is black, at decision block 107, the process proceeds to step 103 and continues as described above. If the sampled color is not black, at decision block 107, the process proceeds to step 103 and continues as described above.

The table 109 provides an example of the physical actions that may be performed by one embodiment of the powered mobile device 13 upon determination that a surface color is other than black. The information in table 109 may be stored in the form of a look-up table (not shown) in the electronics module 35 via any one of various methods well-known in the relevant art. If a red color is detected, for example, a 'wobble' action may be performed. The wobble action may be achieved by alternately applying half-power to each of the drive wheels 23R and 23L. There may also be provided a horn (not shown) in the physical action module 43 on the powered mobile device 13 which may be sounded when certain colors are detected.

If a green color is determined, for example, the powered mobile device 13 may respond and make a right-hand turn by applying a greater amount (e.g., 75%) of motive power to the left drive wheel 23L and a lesser amount (e.g., 25%) of motive power to the right drive wheel 23R. For a blue color determination, the powered mobile device 13 may respond by making a left-hand turn. When magenta has been determined to be the detected color, the powered mobile device 13 may start or continue moving, and then stop while sounding the horn.

If yellow is detected, the powered mobile device 13 may spin about a vertical axis. This spin mode may end via a pre-defined time-out determination, or by an external input such as sound (e.g., a hand clap or shout) or light (e.g., as may be provided by a flashlight). To enable such features, the electronics module 35 may include an audio detection or a light detection circuit (not shown). When cyan is detected, for example, the powered mobile device 13 may proceed forward at full speed. When white is detected, the powered mobile device 13 may proceed forward at normal speed.

Figure 13:
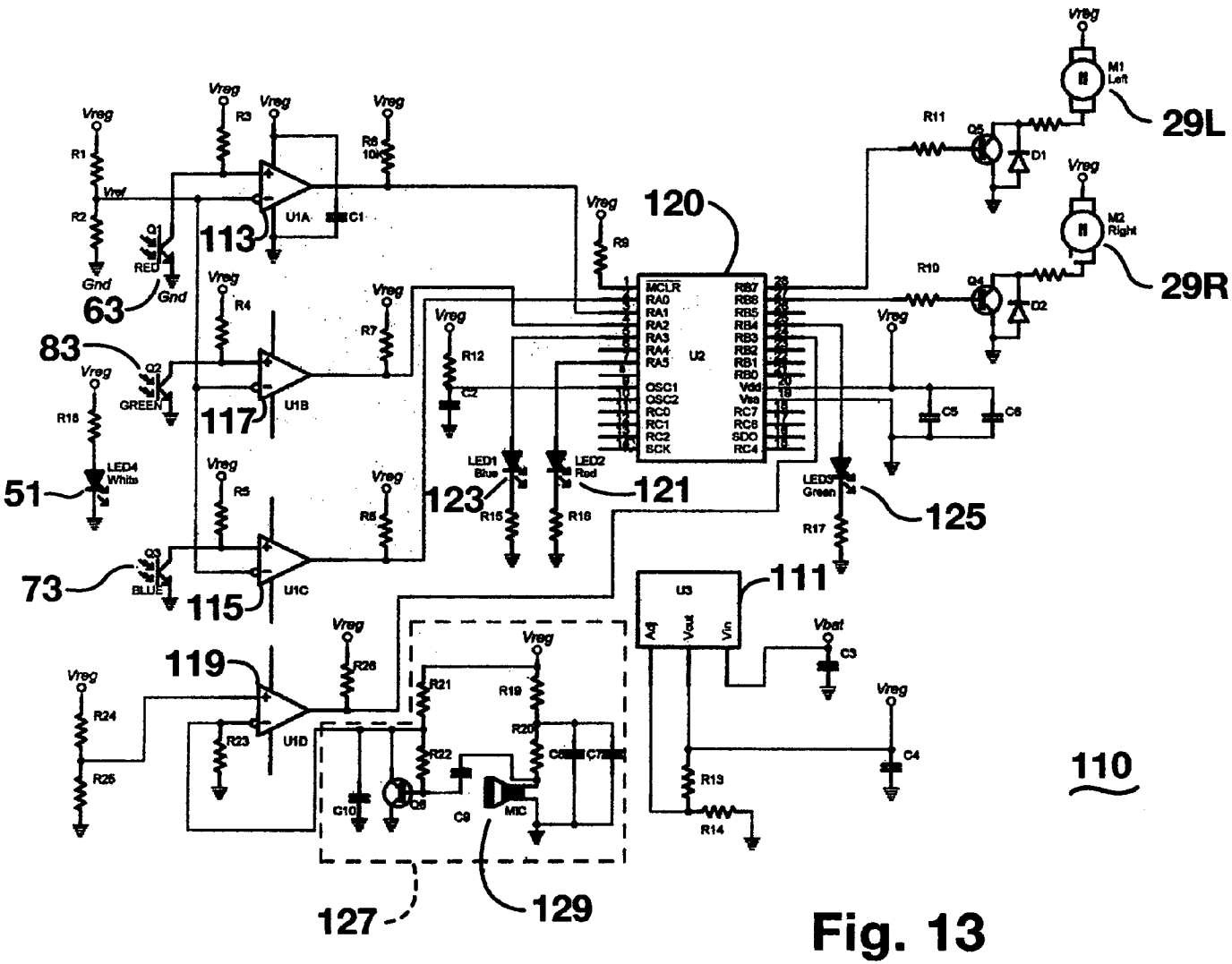
FIG. 13 is a schematic illustrating one embodiment of the color-sensing module of FIG. 3.

One embodiment of the electronics module 35 may be described with reference to a schematic 110 shown in FIG. 13. A regulated voltage is supplied by a voltage regulator 111 and is provided to the broad spectrum illumination source 51. Output signals from the photodetector 63 are provided to a comparator circuit 113. Likewise, output signals from the second photodetector 73 are provided to a second comparator circuit 115, and output signals from the third photodetector 83 are provided to a third comparator circuit 117. As described above, the broad spectrum illumination source 51, the photodetector 63, the photodetector 73, and the photodetector 83 are located in the color detection module 33. The voltage regulator 111 serves to stabilize the output of the illumination source 51 and the response of the photodetectors 63, 73, and 83.

Output signals from the comparator circuit 113, the second comparator circuit 115, and the third comparator circuit 117 are provided to a microcircuit 120 that is programmed to perform the functions described above. There may also be provided optional output indicators, comprising a red LED 121, a blue LED 123, and a green LED 125 to indicate to a user the detection status of or accuracy of color detection by the photodetector 63, the second photodetector 73, and the third photodetector 83, respectively. The red LED 121, the blue LED 123, and the green LED 125 may be used in a simple on/off mode, the three LEDs may be time-modulated using an alternative firmware algorithm to mimic the color of the detected sample, or the light output from the three LEDs can be "blended," that is, the light output may be diffused by passing the outputs of the three indicator LEDs through a common optical element, such as a lens, frosted plastic, or tissue paper.

Motive signals are provided by the microcircuit 120 to the right electrical motor 29R and to the left electrical motor 29L to carry out the motive actions described above. In an alternative embodiment, the electronics module 35 may further comprise a microphone board 127 which inputs ambient sounds, such as a hand-clap command, via a microphone 129 and provides a signal to an audio comparator circuit 119.

Figure 14:
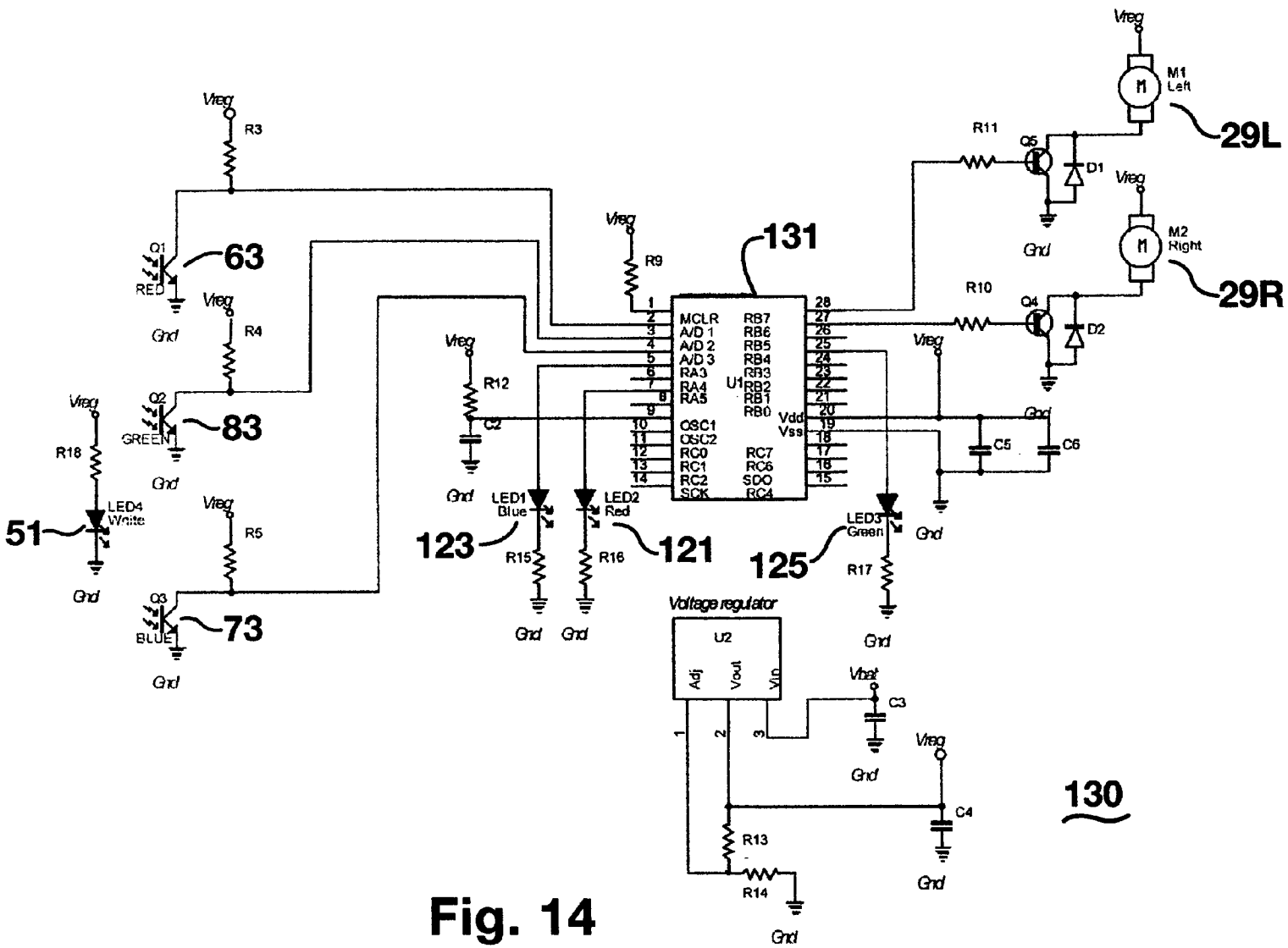
FIG. 14 is a schematic illustrating an alternative embodiment of the color-sensing module of FIG. 3.
Figure 15:
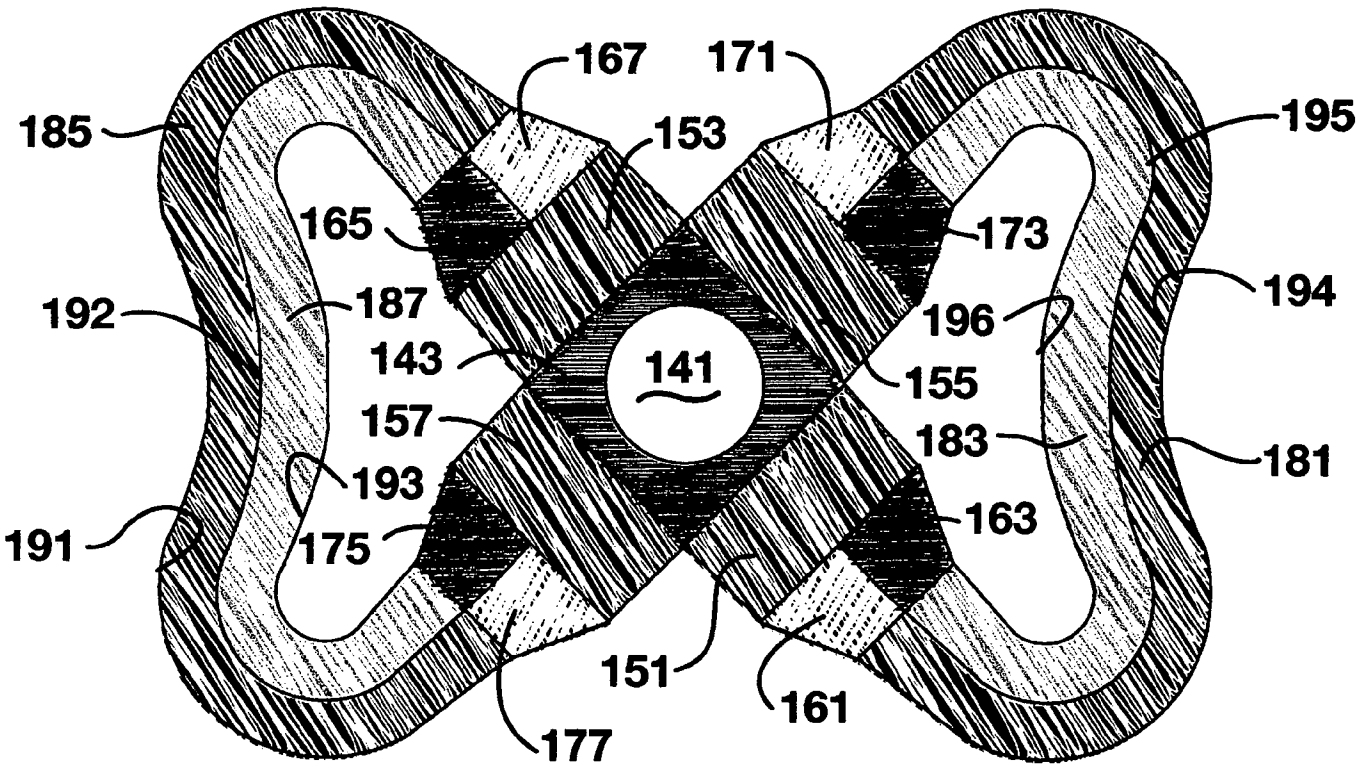
FIG. 15 is an illustration of an alternative play surface used to define a course followed by the mobile body of FIG. 3.

Another embodiment of the electronics module 35 may be described with reference to a schematic 130 shown in FIG. 14. Regulated voltage is supplied to the broad-spectrum illumination source 51 by the voltage regulator 111. The schematic 130 includes the optional red LED 121, blue LED 123, and green LED 125. Motive signals are provided by a microcircuit 131 to the right electrical motor 29R and to the left electrical motor 29L. The schematic 110 shows the right electrical motor 29R and the left electrical motor 29L wired for one direction of motion, but can alternatively be wired for bi-directional motion with the addition of a bridge control circuit (not shown) as well understood in the art. Steering maybe implemented by differential motor speeds, or by utilizing the right electrical motor 29R for driving and the left electrical motor 29L for steering, for example. Alternatively, either or both the right electrical motor 29R and the left electrical motor 29L can be replaced by a servo (not shown).

Signal voltages from the photodetector 63, the second photodetector 73, and the third photodetector 83 is input to respective analog to digital (A/D) converters (not shown) in the microcircuit 131. The microcircuit 131 includes A/D functionality, such as microprocessor components available from various manufacturers, including Microchip Technology Inc. of Chandler, Ariz. This feature allows for greatly improved color identification performance, in comparison to the schematic 110, because the color detection threshold levels for each color detector (for example, RGB or CMYK) may be variable and adaptive, based on the signal level of the other two color detectors. For example, with the fixed comparator design shown in FIG. 13, a bright color sample with a high degree of color impurity (e.g., a substantially red color target having significant quantities of green and blue components) may be incorrectly identified as white. However, with adaptive color identification as made possible by varying the thresholds of each A/D, the same bright color may be correctly identified by considering the relative signal levels of each color. For example, the signal level of the red color in a substantially "red" color target would be greater than the signal levels of either green or blue in the red target, even though each of the red, green, and blue color signals exceeds the threshold.

One or more of the powered mobile device 13 may be used in a toy apparatus for young children, for example, in which there is provided a play surface 140, shown in FIG. 9, and a plurality of colored electrostatic cling vinyl sheets 141–177 which may be temporarily adhered to the play surface 140 to define a course for the powered mobile device 13 to follow. The play surface 140 may comprise a single uniform background color or contain color areas, graphics, and/or text. The play surface 140 may have a very smooth finish suitable for the temporary attachment of a plurality of colored vinyl sheets, as described below. The colored vinyl sheets may be precut pieces or be cut from larger colored vinyl sheets by the user. When placed on the play surface 140 with a user-defined pattern of colored pieces, the motion of the powered mobile device 13 will follow the rules as listed in the Table 109, above.

In the example shown, there is provided a central yellow circle 141 (i.e., cut from a vinyl sheet) disposed on a magenta field 143 (i.e., also cut from a vinyl sheet). The play surface 140 provides four directions in which the powered mobile device 13 may initiate movement from the central yellow circle 141. A first cyan rectangle 151 and a second cyan rectangle 153 may be disposed on opposite sides of the magenta field 143. A first red rectangle 155 and a second red rectangle 157 may also be disposed on opposite sides of the magenta field 143.

A first green trapezoid 161 and a first blue trapezoid 163 are disposed at an edge of the first cyan rectangle 151. A second green trapezoid 165 and a second blue trapezoid 167 are disposed at an edge of the second cyan rectangle 153. A third green trapezoid 171 and a third blue trapezoid 173 are disposed at an edge of the first red rectangle 155. A fourth green trapezoid 175 and a fourth blue trapezoid 177 are disposed at an edge of the second red rectangle 157.

A first white track 181 runs from the first green trapezoid 161 to the third green trapezoid 171, and a parallel second white track 183 runs from the first blue trapezoid 163 to the third blue trapezoid 173. Similarly, a third white track 185 runs from the fourth blue trapezoid 177 to the second blue trapezoid 167 and a parallel fourth white track 187 runs from the fourth green trapezoid 175 to the second green trapezoid 165.

During a typical motive cycle, the powered mobile device 13 may be placed into the yellow circle 141, spin about a vertical axis, and move out of the yellow circle 141 into the magenta field 143. The powered mobile device 13 may then execute a start/stop cycle and enter one of the cyan rectangles 151 and 153, or one of the red rectangles 155 and 157. From there, the powered mobile device 13 may eventually move along one of the white tracks 181, 183, 185, or 187. The white tracks 181, 183, 185, and 187 include border stripes 191–196 to keep the powered mobile device 13 on the respective white tracks 181, 183, 185, and 187.

By the addition of one or more clear vinyl sheets with an imprinted black striped or black crosshatch pattern, additional functions may be incorporated. A small sheet of such material (not shown) may be overlaid on one of the first seven colors, above. With the additional clear vinyl in place on a selected color, the action defined by the color may take place at a faster speed. For example, a clear vinyl with black stripes placed over green vinyl could cause the powered mobile device 13 to make a right turn at high speed. In another embodiment, color sensing of more than eight colors is accomplished by differentiating between the levels detected by each of the three photodetectors 63, 73, and 83.

Using the electric motors 29R and 29L in a two-motor differential steering configuration can be very effective in creating a wide selection of vehicle behaviors by varying the speed of the left and right drive wheels 23L and 23R. To avoid situations in which a faster wheel "pulls" a slower wheel along at greater than its driven speed, the powered mobile device 13 may comprise a worm gear drive element (not shown) in the gear system of the electric motors 29R and 29L. Since a worm gear is not typically driven by its mating spur gear, the speed of the driven wheel should be as expected.

Figure 16:
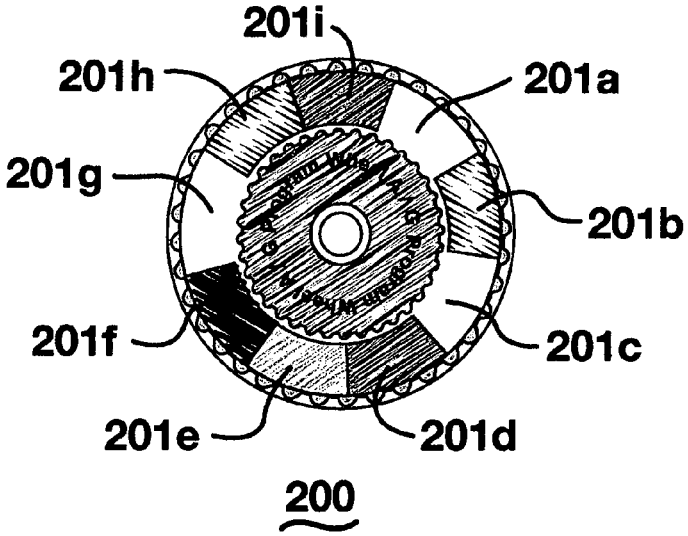
FIG. 16 is a diagrammatical illustration of a programming disk.
Figure 17:
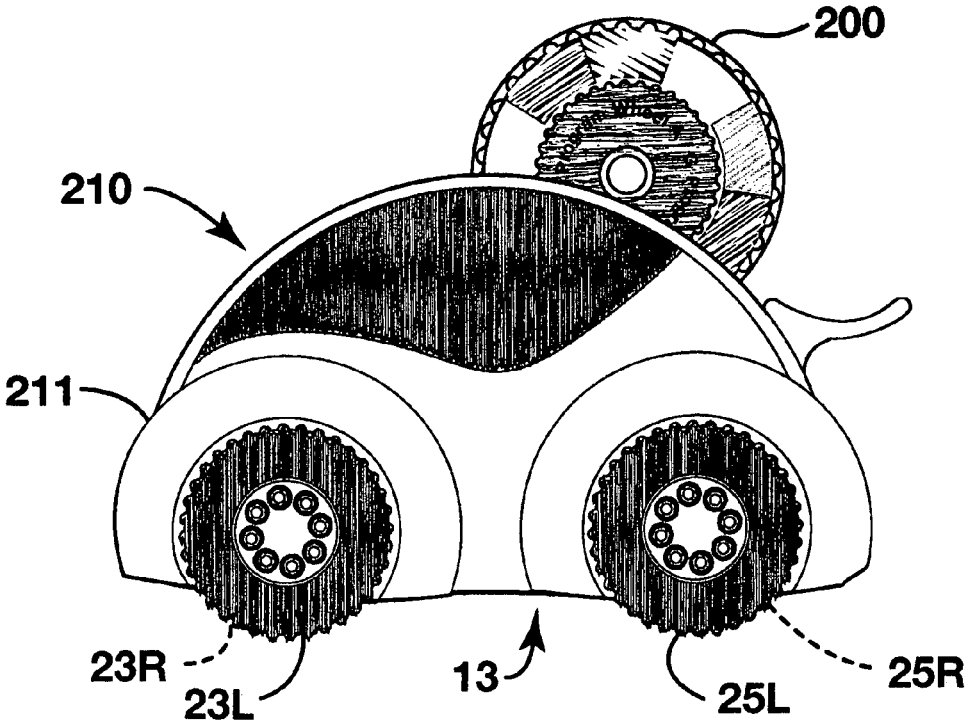
FIG. 17 is a diagrammatical illustration of an alternative embodiment of the mobile device of FIG. 1 in accordance with the present invention reading the programming disk of FIG. 16.

In yet another embodiment, shown in FIGS. 16 and 17, there is provided a programming disk 200 having a plurality of colors 201*a*–201*i*, where the disk can be inserted into a reader (not shown), such as may be included in a powered mobile vehicular toy 210. The powered mobile vehicular toy 210 includes the powered mobile device 13 enclosed by an outer molded enclosure 211, here configured as an automotive body with drive wheels 23R and 23L, and rear wheels 25R and 35L. The programming disk 200 can be rotated by a drive system (not shown) connected to one or both of the electric motors 29R and 29R (not shown) in the powered mobile device 13 to "program" the behavior of the powered mobile vehicular toy 210. If incremental motion of the programming disk 200 is desired, a Geneva mechanism or a solenoid driven ratcheting device (not shown) can be used in the powered mobile device 13.

In still more embodiments, the behaviors produced by the powered mobile device 13 include: a) varying the speed and direction of the powered mobile device 13, b) producing entire vehicle dramatic motion, c) having the powered mobile device 13 flip over, d) an exploding tank, e) a plane dives, f) a boat submerges and returns to surface, g) various audio or sound behaviors, h) variations of a honking horn, i) sound effects related to toy action or theme, j) the sound of an engine revving, k) the screeching of tires sound, l) the whistle of a train, m) a musical passage related to toy action or theme, n) voice messages either prerecorded or recordable by the user, o) visual behaviors, p) headlamps flashing, q) use of strobe lights, r) projecting an image on ceiling (in a dark room), s) low-resolution text display using an LED array, t) vehicle color change using a translucent body and a backlight, u) various mechanized actions, v) robotic arm deployment, w) initiating a smoke generation device, x) initiating the squirting of water, and y) initiating a comical hand-waving effect.

If the powered mobile device 13 does not run on a floor or special play surface with either embedded color or stick-on colors, the programming disk 200 described above may be required in order to "color program" behavior, especially for a toy plane or a boat. Cars and trains may also use the programming disk. In yet another embodiment, a non-self-propelled device (not shown) does not use the electric motors 29R and 29L for self propulsion and instead comprises a user-controlled device which is pushed by hand. Otherwise, the non-self-propelled device performs the same physical actions and operations described above for the powered mobile device 13.

Figure 18:
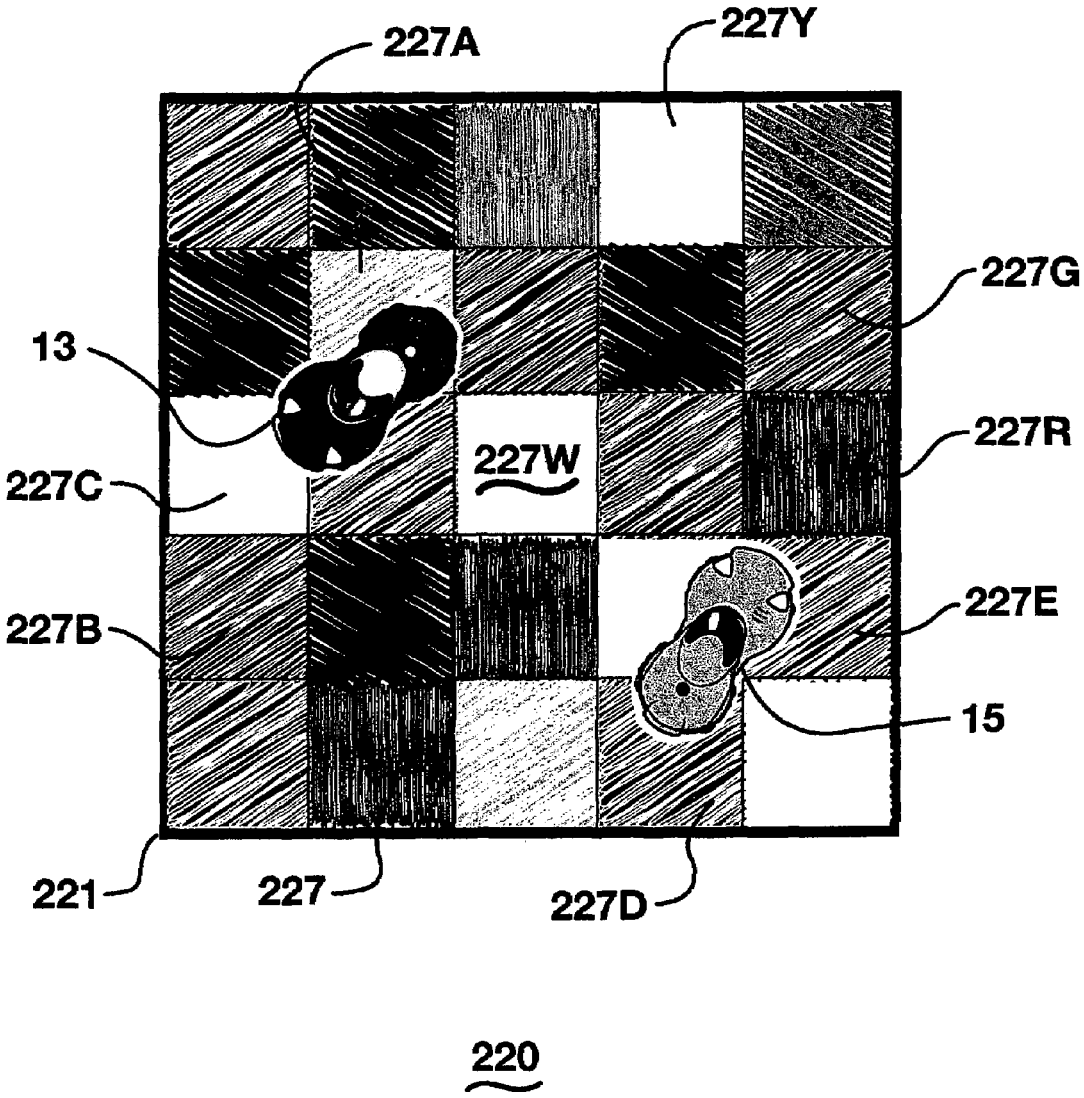
FIG. 18 is an illustration showing an alternative embodiment of the mobile devices of FIG. 1 disposed on a checkered action surface having a plurality of colored regions, according to the present invention.

There is shown in FIG. 18 a second embodiment of an action game 220, including an action surface 221 upon which are disposed the powered mobile device 13 and the non-powered mobile device 15. The action surface 221 is a generally planar surface which may comprise a plurality of colored squares 227 to form a checkered configuration. The action surface 221 may include, for example, one or more of a yellow square 227Y, a green square 227G, a red square 227R, a blue square 227B, and a white square 227W.

As the powered mobile device 13 moves onto a first colored square 227A, the color of the colored square 227A is identified by the powered mobile device 13 and, in response to the first color identification, the powered mobile device 13 executes a first physical action, such as a turning action or by generating a sound, for example. The powered mobile device 13 may then continue across the action surface 221 to move onto a second colored square 227C, and execute a second physical action in response to a second color identification. Similarly, as the non-powered mobile device 15 moves onto a third colored square 227D, the color of the third colored square 227D is identified by the non-powered mobile device 15 and, in response to the third color identification, the non-powered mobile device 15 executes a third physical action, such as by momentarily stopping or by flashing a light, for example. The non-powered mobile device 15 may then continue across the action surface 221 to move onto a fourth colored square 227E, and execute a fourth physical action.

Figure 19:
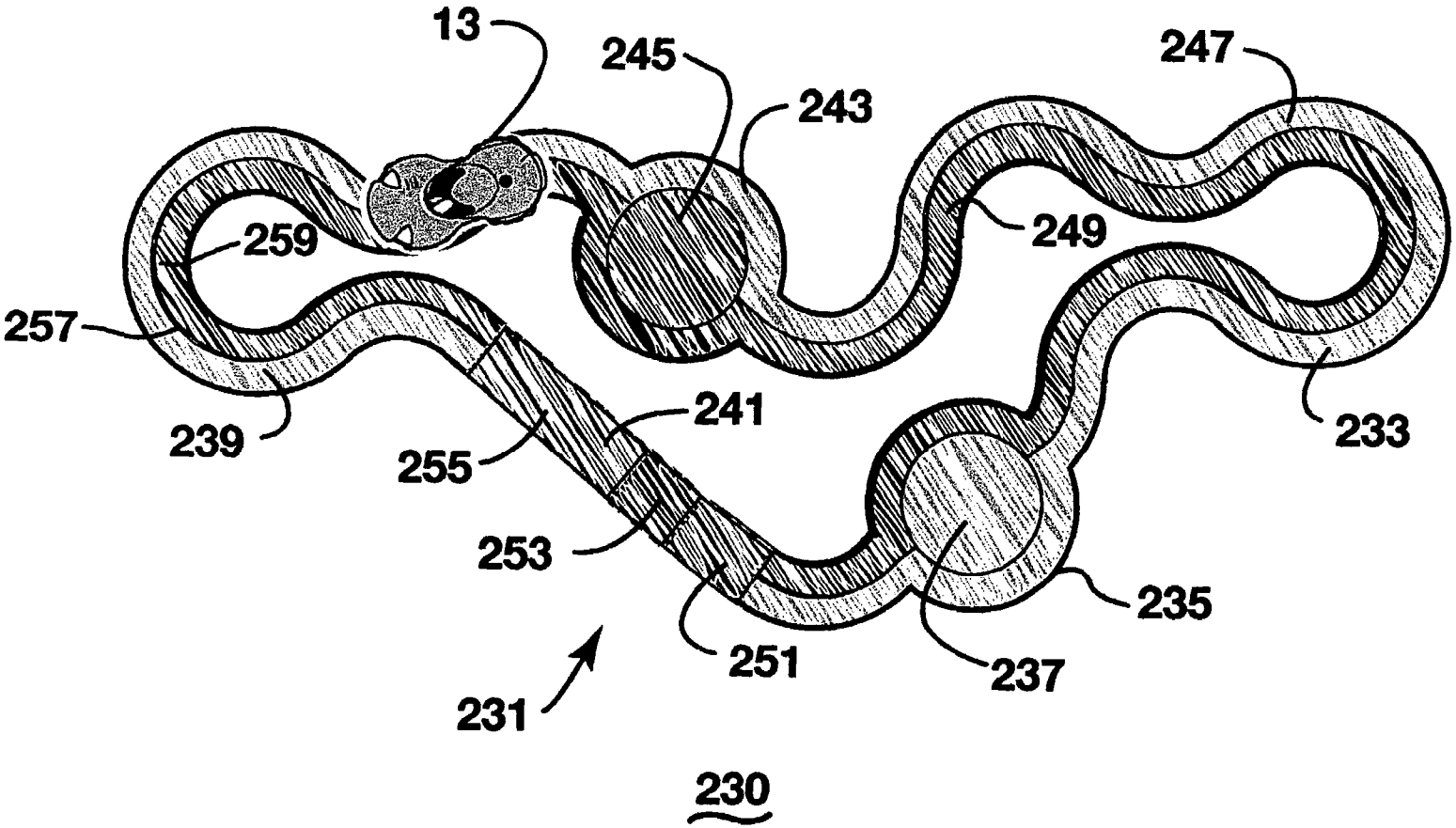
FIG. 19 is an illustration showing the mobile device of FIG. 1 disposed on an alternative action surface having the shape of a curved track, according to the present invention.

A third embodiment of an action game 230, shown in FIG. 19, includes the powered mobile device 13 placed on an action track 231. The action track 231 may be a generally piecewise-continuous series of straight and curved strips and shapes of sufficient width to accommodate emplacement of the powered mobile device 13. The action track 231 may include, for example, a curvy section 233 having a green longitudinal stripe 247 and a blue longitudinal stripe 249, and a circular section 235 having a magenta central circular region 237. The action track 231 may also include a second curvy section 239 having a straight section 241 with a cyan patch 251, a white patch 253, and a second cyan patch 255. Additionally, the action track 231 may include a curvy green stripe 257 and a curvy blue stripe 259. There may also be a second circular section 243 having a yellow central circular region 245. As the powered mobile device 13 moves along the curvy section 233, the green stripe 247 on the left and the blue stripe 249 on the right may function to keep the first mobile device within the curvy section 233 and the circular section 235. For example, when the powered mobile device 13 detects the green stripe 247, the powered mobile device 13 turns to the right, and when the powered mobile device 13 detects the blue stripe 249, the powered mobile device 13 turns to the left, where both of these actions tend to bring the powered mobile device 13 to the center of either the curvy section 233 or the circular section 235.

When the powered mobile device 13 moves across the magenta central circular region 237, the powered mobile device 13 may sound a horn (not shown) and continue to move in a straight line onto the second curvy section 239. When the powered mobile device 13 detects the cyan patch 251, the powered mobile device 13 may increase speed and continue to move in a straight line. When the powered mobile device 13 reaches the white patch 253, the powered mobile device 13 may decrease speed and continue to move in a straight line. Then, when the powered mobile device 13 detects the second cyan patch 255, the powered mobile device 13 may again increase speed and continue to move in a straight line to the second circular section 243. When the powered mobile device 13 moves across the yellow central circular region 245, the powered mobile device 13 may spin and continue to move into the curvy section 233. In alternate embodiments, the action surface 221 and the action track 231 may be provided as a roll-out mat or a fold-out board, for example, and may include three-dimensional terrain or other features. There may be provided border restraints (not shown), such as walls, at the periphery of the action surface 221, or raised roadway restraints (not shown) at the boundaries of the action track 231.

While the invention has been described with reference to particular embodiments, it will be understood that the present invention is by no means limited to the particular constructions and methods herein disclosed and/or shown in the drawings, but also comprises any modifications or equivalents within the scope of the claims.

What is claimed is:

1. A mobile device with color discrimination suitable for producing a physical action in response to the detection of a color on an action surface, said mobile device comprising:

a mobile body having a first wheel, a second wheel, and a third point of contact with the action surface;

means for executing the physical action;

a color detection module attached to said mobile body for producing color detection signals in response to detecting colors on the action surface, said color detection module including a broad spectrum illumination source with a source lens, said illumination source for producing a spot of light on the action surface;

a photodetector with a bandpass filter, said photodetector for receiving light reflected from said spot of light and transmitted through said bandpass filter;

a second photodetector with a second bandpass filter, said second photodetector for receiving light reflected from said spot of light and transmitted through said second bandpass filter;

an electronics module for receiving color detection signals and to produce the physical action in response thereto, said electronics module including a comparator circuit in electronic communication with said photodetector;

a second comparator circuit in electronic communication with said second photodetector; and a microcircuit in electronic communication with said comparator circuit and said second comparator circuit, said microcircuit further in communication with said means for executing the physical action.

2. A mobile device as in claim 1 wherein said means for executing the physical action comprises a physical action module including at least one of the group consisting of: a light source, an audio generator, and a smoke generator.

3. A mobile device as in claim 1 wherein said broad spectrum illumination source comprises a member of the group consisting of: a white light-emitting diode, an incandescent light source, and an arc source.

4. A mobile device as in claim 1 wherein said color detection module further comprises a third photodetector with a third bandpass filter, said third photodetector for receiving light reflected from said spot of light and transmitted through said third bandpass filter.

5. A mobile device as in claim 1 wherein said electronics module further comprises a third comparator circuit in electronic communication with said color detection module.

6. A mobile device as in claim 1 wherein said bandpass filter comprises a member of the group consisting of: a red bandpass filter, a green bandpass filter, a blue bandpass filter, a cyan bandpass filter, a magenta bandpass filter, and a yellow bandpass filter.

7. A mobile device as in claim 1 further comprising an outer enclosure attached to said mobile body.

8. A mobile device as in claim 7 wherein said outer enclosure comprises a molded enclosure shaped in the form of an object from the group consisting of: a vehicle, an animal, a human figure, and a sport accessory.

9. A mobile device as in claim 1 wherein said means for executing the physical action comprises an electrical motor connected to at least said first wheel, said mobile device further comprising a power source for powering said electrical motor.

10. A mobile device as in claim 9 wherein said power source comprises a member of the group consisting of: a battery, a solar cell, and a spring.

11. A mobile device as in claim 9 further comprising a second electrical motor connected to said second wheel, said mobile device further comprising a second power source for powering said second electrical motor.

12. A mobile device as in claim 1 wherein said color detection module further comprises an infrared blocking filter proximate said illumination source.

13. A mobile device as in claim 1 wherein said electronics module further comprises an audio comparator circuit in electrical communication with a microphone.

14. A method for producing a physical action in a mobile device in response to placement of the mobile device on an action surface having a plurality of colored regions, said method comprising the steps of:

projecting a spot of light originating from the mobile device onto a region of the action surface below the mobile device;

inputting at least two light beams reflected from the action surface to a color detection module in the mobile device, said color detection module having means to discriminate among at least four colors other than black;

determining a color for the region of the action surface below the mobile device; and signaling the mobile device to execute a physical action corresponding to said determined color.

15. A method as in claim 14 wherein said spot of light comprises a broad spectrum spot of light.

16. A method as in claim 14 wherein said color detection module comprises at least two photodetectors and at least two bandpass filters.

17. A method as in claim 14 wherein said step of determining a color for the region of the action surface below the mobile device is performed by an electronics module disposed in the mobile device, said electronics module having at least two comparator circuits in electrical communication with said color detection module.

18. A method as in claim 14 wherein each of said at least two bandpass filters comprises a member of the group consisting of: a red bandpass filter, a green bandpass filter, a blue bandpass filter, a cyan bandpass filter, a magenta bandpass filter, and a yellow bandpass filter.

19. A method as in claim 14 wherein the physical action comprises a member of the group consisting of: translating the mobile device via an internal motor, turning one or more wheels on the mobile device, spinning the mobile device around a vertical axis, emitting a light from the mobile device, generating an audible sound in the mobile device, and producing smoke from the mobile device.

20. A method as in claim 14 wherein the physical action is produced in response to a user translating the mobile device through the plurality of colored regions.

* * * * *